US007525449B1

(12) United States Patent
Lafontaine

(10) Patent No.: US 7,525,449 B1
(45) Date of Patent: Apr. 28, 2009

(54) STATUS LIGHT FOR SWITCH ON BOAT STEERING WHEEL

(75) Inventor: Yvan Lafontaine, Grande-Mère (CA)

(73) Assignee: Teleflex Megatech, Inc., Grand-Mere, Quebec (CA)

( * ) Notice: Subject to any disclaimer, the term of this patent is extended or adjusted under 35 U.S.C. 154(b) by 0 days.

(21) Appl. No.: 10/961,224

(22) Filed: Oct. 12, 2004

Related U.S. Application Data

(60) Provisional application No. 60/516,757, filed on Nov. 4, 2003, provisional application No. 60/512,089, filed on Oct. 20, 2003, provisional application No. 60/512,100, filed on Oct. 20, 2003.

(51) Int. Cl.
*G08B 23/00* (2006.01)

(52) U.S. Cl. ..... 340/984; 340/982; 340/575; 340/576; 340/425.5; 340/438; 340/475; 307/9.1; 307/10.1; 307/17

(58) Field of Classification Search ..... 340/984, 340/982, 575, 576, 425.5, 438, 475; 307/10.1, 307/9.1, 17
See application file for complete search history.

(56) References Cited

U.S. PATENT DOCUMENTS 3,652,868 A 3/1972 Hunt
3,789,231 A 1/1974 Hayden
3,857,359 A 12/1974 Ward et al.
4,368,454 A * 1/1983 Pilatzki ..... 74/484 R
4,405,924 A 9/1983 Shinoda
4,438,425 A 3/1984 Tsuchida et al.
4,456,903 A 6/1984 Kishi et al.
4,514,645 A 4/1985 Endo et al.
4,604,912 A 8/1986 Sugita et al.
4,608,550 A * 8/1986 Umebayashi et al. ..... 307/10.1
4,609,904 A 9/1986 Paine
4,628,310 A 12/1986 Reighard et al.
4,635,029 A * 1/1987 Yamada ..... 398/136
4,638,131 A 1/1987 Kidd
4,672,214 A 6/1987 Takahashi
4,678,906 A 7/1987 Rudi et al.
4,737,761 A 4/1988 Dosjoub et al.
4,757,212 A * 7/1988 Saito ..... 307/10.1
4,757,213 A 7/1988 Tigges et al.
4,766,326 A 8/1988 Hayashi et al.
4,772,799 A 9/1988 Inui
4,792,783 A 12/1988 Burgess
4,792,965 A 12/1988 Morgan
4,835,512 A 5/1989 Bratton
4,855,144 A 8/1989 Leong et al.

(Continued)

FOREIGN PATENT DOCUMENTS

CA 2071681 12/1992

(Continued)

*Primary Examiner*—Tai T Nguyen
(74) *Attorney, Agent, or Firm*—Baker Hostetler LLP

(57) ABSTRACT

According to a first broad aspect of the present invention, there is provided a method and system for indicating a status of a subsystem controlled by a switch provided on a steering wheel of a marine vehicle. The method and system comprise: providing a switch for the subsystem on the steering wheel of the marine vehicle; providing a status indicator for the switch; detecting an activation of the switch; transmitting a command to the subsystem in the marine vehicle in response to the activation; detecting an operation status of the subsystem in response to the command; and activating the status indicator to indicate information of the operation status.

20 Claims, 4 Drawing Sheets

U.S. PATENT DOCUMENTS

| | | | | |
|---|---|---|---|---|
| 4,879,476 | A | | 11/1989 | Schweizer |
| 4,944,241 | A | | 7/1990 | Carter |
| 4,962,495 | A | | 10/1990 | Gibbons |
| 5,003,906 | A | | 4/1991 | Sova |
| 5,041,817 | A | | 8/1991 | Reeb |
| 5,049,082 | A | | 9/1991 | Carter |
| 5,132,665 | A | | 7/1992 | Hutchisson et al. |
| 5,337,694 | A | | 8/1994 | Nix |
| 5,498,911 | A | | 3/1996 | Bossler et al. |
| 5,515,399 | A | | 5/1996 | Swart |
| 5,555,502 | A | * | 9/1996 | Opel ..... 701/36 |
| 5,585,785 | A | | 12/1996 | Gwin et al. |
| 5,666,102 | A | | 9/1997 | Lahiff |
| 5,707,262 | A | | 1/1998 | Huntley et al. |
| 5,719,824 | A | | 2/1998 | Boucher |
| 5,724,907 | A | | 3/1998 | Castellucci |
| 5,787,833 | A | | 8/1998 | Lewis |
| 5,810,606 | A | | 9/1998 | Ballast et al. |
| 5,833,025 | A | | 11/1998 | Bhandari |
| 5,855,144 | A | | 1/1999 | Parada |
| 5,856,710 | A | | 1/1999 | Baughman et al. |
| 5,876,335 | A | * | 3/1999 | Handy et al. ..... 600/304 |
| 5,945,744 | A | | 8/1999 | Dobler et al. |
| 5,994,788 | A | | 11/1999 | Dobler et al. |
| 6,012,736 | A | | 1/2000 | Hansen |
| 6,054,778 | A | | 4/2000 | Downs |
| 6,078,252 | A | | 6/2000 | Kulczycki et al. |
| 6,091,779 | A | | 7/2000 | Griessbach |
| 6,114,949 | A | | 9/2000 | Schmitz et al. |
| 6,121,692 | A | | 9/2000 | Michaels et al. |
| 6,169,339 | B1 | | 1/2001 | Cripe |
| 6,232,871 | B1 | | 5/2001 | Spiess |
| 6,253,131 | B1 | | 6/2001 | Quingley et al. |
| 6,262,513 | B1 | | 7/2001 | Furukawa et al. |
| 6,264,513 | B1 | | 7/2001 | Marsh |
| 6,271,741 | B1 | | 8/2001 | Sajna |
| 6,292,069 | B1 | | 9/2001 | Michaels et al. |
| 6,343,670 | B1 | | 2/2002 | Mindl et al. |
| 6,388,548 | B1 | | 5/2002 | Saito et al. |
| 6,501,361 | B1 | | 12/2002 | Michaels et al. |
| 6,554,303 | B2 | | 4/2003 | Benz et al. |
| 6,670,722 | B1 | | 12/2003 | Kessell et al. |
| 2002/0041074 | A1 | | 4/2002 | Benz et al. |
| 2002/0125061 | A1 | | 9/2002 | Kawamura |
| 2002/0171522 | A1 | | 11/2002 | Kazmierczak |
| 2003/0150366 | A1 | | 8/2003 | Kaufmann et al. |
| 2003/0179105 | A1 | | 9/2003 | Kazmierczak |

FOREIGN PATENT DOCUMENTS

| | | | |
|---|---|---|---|
| CA | 2073845 | | 2/1993 |
| CA | 2317346 | | 3/2001 |
| CA | 2318596 | | 3/2001 |
| DE | 69816429 | | 4/2004 |
| EP | 0183580 | A1 | 6/1986 |
| EP | 0451445 | A2 | 10/1991 |
| EP | 0528463 | A1 | 2/1993 |
| EP | 0680060 | A1 | 11/1995 |
| EP | 0679554 | B1 | 11/2002 |
| EP | 0969989 | | 7/2003 |
| JP | 2001521463 | | 11/2001 |
| WO | WO9712783 | A2 | 4/1997 |

* cited by examiner

STATUS LIGHT FOR SWITCH ON BOAT STEERING WHEEL

CROSS-REFERENCE TO RELATED APPLICATIONS

This application claims priority under 35 USC §119(e) of U.S. provisional patent applications 60/516,757, filed on Nov. 4, 2003, entitled "Status Light on a Marine vehicle Steering Wheel Switch"; 60/512,089, filed on Oct. 20, 2003, entitled "Contactless Steering Wheel Switch Powering"; and 60/512,100, filed on Oct. 20, 2003, entitled "Contactless Steering Wheel Switch Powering"; by applicant, the specifications of which are hereby incorporated by reference.

FIELD OF THE INVENTION

The present invention relates to switches made available on steering wheels of marine vehicles. More specifically, it relates to switches for activating subsystems that comprise indicators for confirmation of subsystem functionality.

BACKGROUND OF THE INVENTION

Prior art systems which provide lights on switches allow a user to be sure that the switch has been activated, a good example of this is the small light that is activated on the rear window defroster button in many car models when the defroster button is pressed down. Such visual indicators confirm that the command was requested. The way they function is that when the switch is not activated, electric current reaches neither the indicator, nor the subsystem. Whereas when the switch is activated, both the indicator and the subsystem are powered. Similar switches are provided on the dashboard of marine vehicles.

When the switch is activated and there is a problem with the subsystem, the indicator stays lit and the problem may remain unnoticed by the operator; thereby creating a potentially dangerous situation for the operator and the other people on the marine vehicle. This is especially true in the case of actuating a bilge blower to evacuate fuel fumes. If the indicator is lit even though the blower is malfunctioning, the user might believe that the bilge blower is functioning, and start the marine vehicle even though gas fumes are still present. Ignition of the fuel fumes by a spark during motor startup may lead to serious injury or death of the marine vehicle occupants.

SUMMARY OF THE INVENTION

Accordingly, an object of the present invention is to provide an indication of the actual status of a subsystem controlled by a switch instead of only providing an indication that the subsystem is under tension.

According to a first broad aspect of the present invention, there is provided a method for indicating a status of a subsystem controlled by a switch provided on a steering wheel of a marine vehicle, comprising: providing a switch for the subsystem on the steering wheel of the marine vehicle; providing a status indicator for the switch; detecting an activation of the switch; transmitting a command to the subsystem in the marine vehicle in response to the activation; detecting an operation status of the subsystem in response to the command; and activating the status indicator to indicate information of the operation status.

According to another broad aspect of the present invention, there is provided a system for indicating a status of a subsystem controlled by a switch provided on a steering wheel of a marine vehicle, comprising: a switch for the subsystem on the steering wheel of the marine vehicle; a status indicator for the switch; an activation detector for detecting an activation of the switch; an activation transmitter for transmitting a command to the subsystem in the marine vehicle in response to the activation; an operation detector for detecting an operation status of the subsystem in response to the command; and an indicator activator for activating the status indicator to indicate the operation status.

BRIEF DESCRIPTION OF THE DRAWINGS

These and other features, aspects and advantages of the present invention will become better understood with regard to the following description and accompanying drawings wherein.

DETAILED DESCRIPTION OF THE PREFERRED EMBODIMENT

Concurrently with the present invention, an energy accumulator can be provided in the steering wheel assembly of a marine vehicle. The energy accumulator has enough energy to allow powering a switch in the steering wheel assembly, and transmitting data from the steering wheel assembly towards the dashboard or anywhere else in the main body of the marine vehicle whether the ignition is turned on or off. The data and energy transmission can be done without electrical connection between the main body of the marine vehicle and the steering wheel assembly. The details of such data and energy transmission methods and systems are found in co-pending U.S. patent application Ser. No. 10/961,297, filed on Oct. 12, 2004 by Applicant, which is incorporated herewith by reference.

In the description of the present invention, it will be assumed that the energy provided in the steering wheel is managed by a power management system and that having sufficient energy to operate the system described and carry out the steps of the method described is not an object.

Figure 1A:
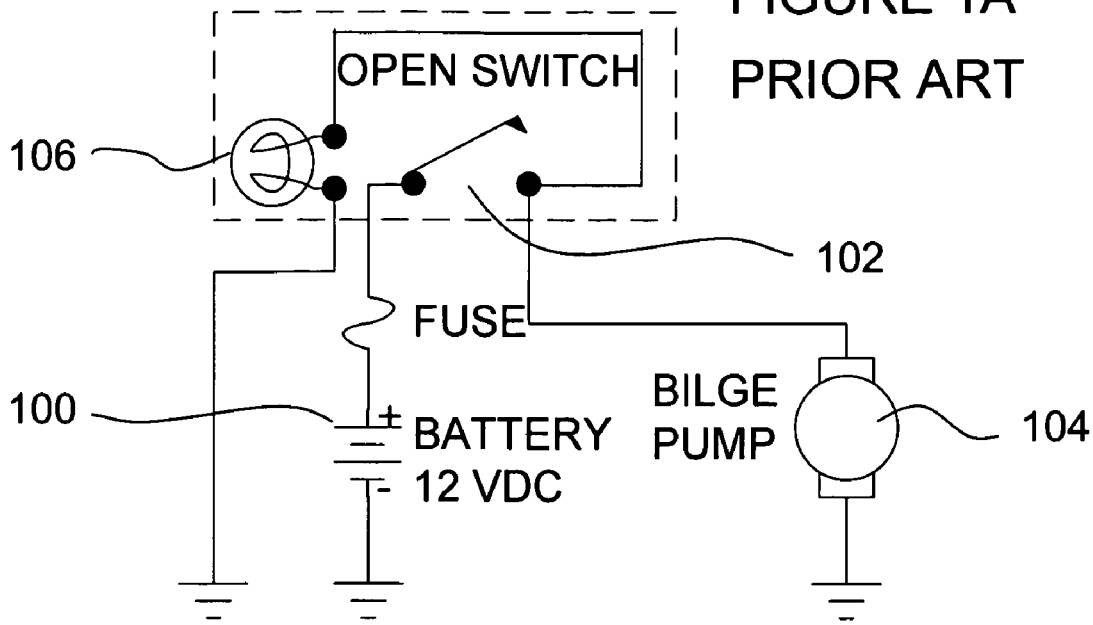
FIGURE 1A PRIOR ART
FIG. 1 comprises FIG. 1A and FIG. 1B, and is an example of a prior art system, in FIG. 1A the switch is open, whereas in FIG. 1B, the switch is closed.
Figure 1B:
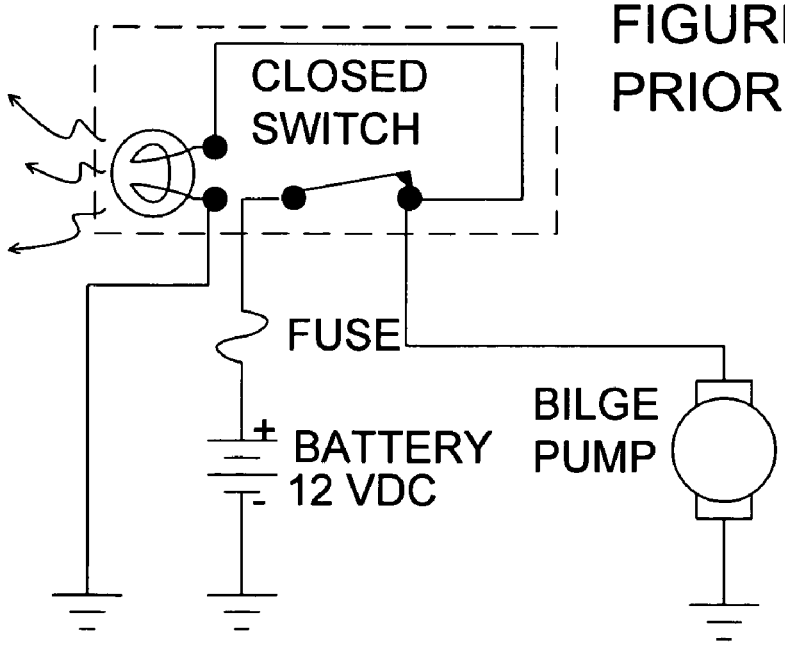
FIGURE 1B PRIOR ART

FIG. 1 is an example of a prior art system. A battery 100 supplies energy. In FIG. 1A, the switch 102 is open, therefore the subsystem 104 and the LED (Light Emitting Diode) 106 are not powered. In FIG. 1B, the switch is closed, the subsystem and the LED are energized.

In the following description, please note that the term 'steering wheel assembly' comprises all components which are assembled to the steering wheel. In the preferred embodiment, the steering wheel assembly comprises the steering wheel, switches, the switch processor, indicators and other electronic circuitry.

Figure 2:
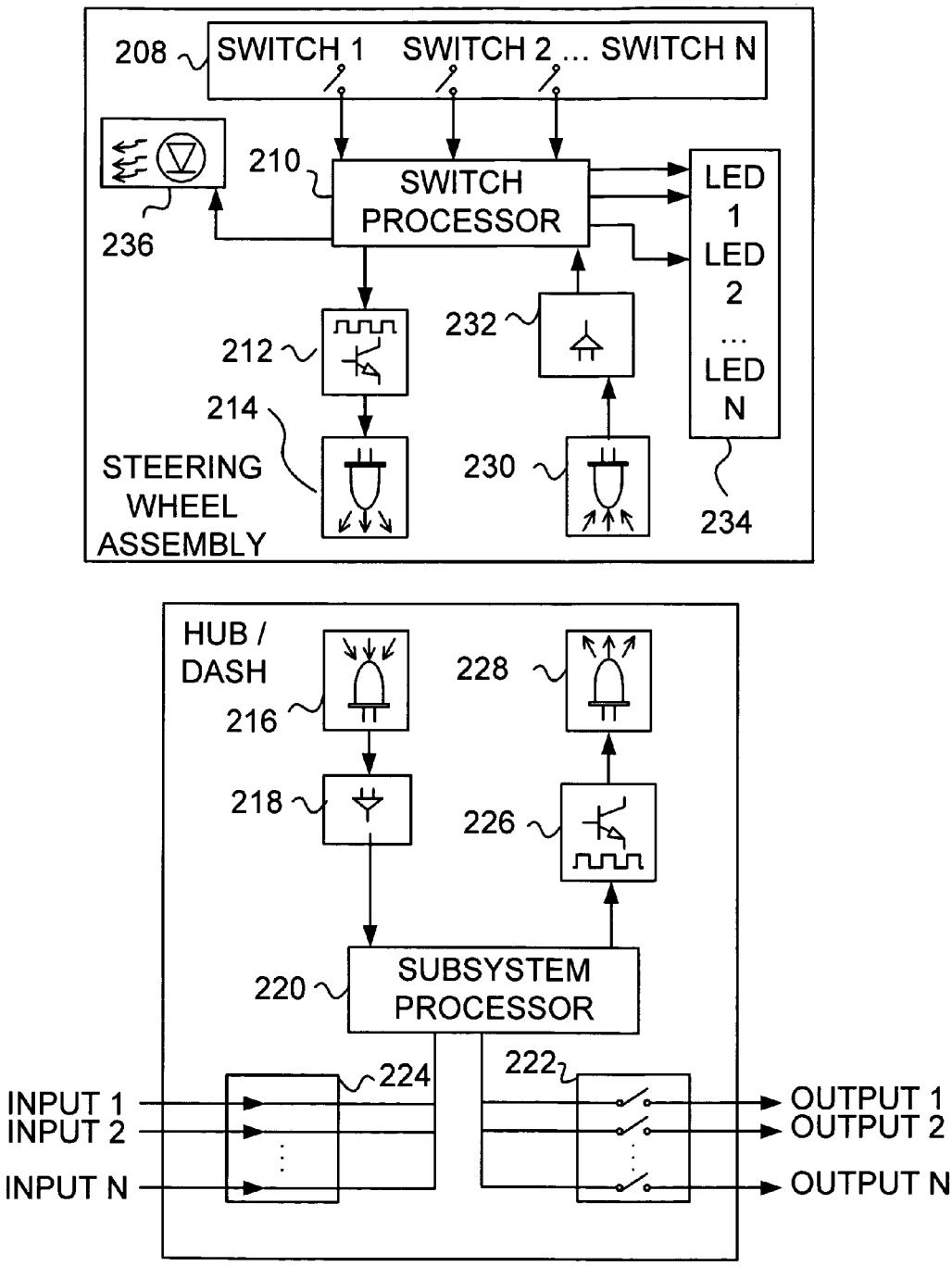
FIG. 2 is a block diagram of the main components of a preferred embodiment of the present invention.

With reference to FIG. 2, a preferred embodiment of the present invention will be explained in detail. Switches 208 are provided on a steering wheel of a marine vehicle. The switches 208 can be used to control a plurality of subsystems of the marine vehicle, such as the lights, the horn, the fan, the windshield wipers and washer, the bilge pump, the bilge blower, the emergency start, the electric anchor, the hazard warning, the radio, the trim tab, the power trim, etc. The switches 208 are preferably provided on a keypad that is affixed to the steering wheel. This keypad should be weather resistant if the steering wheel is not protected from the weather. The switches will typically bear pictograms or logos representing the subsystem that they control. They can also bear the name of the subsystem. Switch standards exist for marine vehicles and should be used when appropriate.

A switch processor 210 reads the electrical signals from the switches 208 of the steering wheel assembly. The switches are provided to a user, and activating a switch is meant to activate a corresponding subsystem. The switch processor 210 then transmits an activation data train, created by an activation data driver 212, via IR (infrared) transmission using an activation IR emitting diode 214. The activation data train identifies the switch(es) activated in the steering wheel and therefore contains an indication of the command to which the system must react. The activation data train is captured by an activation phototransistor 216, is then received by an activation receiver 218 and is thereafter sent to a subsystem processor 220 for communication with the proper subsystem of the marine vehicle via the interface 222.

The interface 222 has at least as many outputs as there are switches 208 on the steering wheel. The interface 222 can have solid state switches or electromechanical relays. It is possible to use the interface 222 to communicate on a data network of the marine vehicle, in which case the interface 222 also comprises a multiplexer. The National Marine Electronics Association has introduced the NMEA 2000 interface standard. The standard contains the requirements of a serial data communications network to inter-connect marine electronic equipment on vessels. It is multi-master and self configuring, and there is no central network controller. Equipment designed to this standard have the ability to share data, including commands and status with other compatible equipment over a single channel. If the interface 222 is compliant with the NMEA 2000 standard, it can allow communication between the switches 208 and the devices of the network. The infrared activation data train, discussed in the previous paragraph, or any infrared data train is considered the physical layer in data communications. The physical layer is the most basic network layer, providing the means of transmitting raw bits rather than packets over a physical data link connecting network nodes. Therefore, the infrared activation data train can be deployed using the NMEA 2000 interfacing standards mentioned above or any error checking data transmission encoder/decoder scheme.

Similarly, inputs 224 contain status signals indicating the operation status of the different subsystems of the marine vehicle. Each subsystem for which an operation command was given by a user activating a corresponding switch may either be 'functioning' or 'malfunctioning', which is referred to as the operation status of the subsystem. The status information signals are first received by the subsystem processor 220 which transmits a status data train, created by a status data driver 226, via IR transmission using a status IR emitting diode 226. The status data train identifies the status of each subsystem of the marine vehicle corresponding to its activation by a switch in the steering wheel and therefore contains an indication of whether the switch command was successful or not. The status data train is captured by a status phototransistor 230, is received by the status receiver 232 and is sent to the switch processor 210 for analysis.

Status indicators preferably provided on or near the switches for immediate interpretation are used to indicate the operation status of the subsystems to a user. Usually, LEDs 234 next to the switches are used, but other types of indicators may also be used as will be discussed further on. Typically, the status LED 234 is lit when the corresponding switch 208 has been pressed and the subsystem is functioning normally, thus executing the command. If the switch has not been pressed, no operation takes place, and the status LED 234 stays unlit. If the switch has been pressed but the corresponding subsystem is not responding, cannot execute the command, or is otherwise malfunctioning, it has proven advantageous to have the status LED flash or to otherwise indicate the malfunctioning operation status. In case of vital subsystems, this LED will preferably be combined with other visual indicators or with an audible indicator.

Backlighting of the switches 208, backlighting of a portion of the switches, like a backlighting ring around the switches, or backlighting the keypad on which the switches are provided can advantageously be combined with or substituted to the LED(s) as alternate or additional visual indicators. Use of backlighting is made by using a backlighting circuitry 236. Furthermore, differently colored LEDs or flashing LEDs corresponding to different operation statuses may also be used. Distinctive combinations of colored LEDs, flashing LEDs, backlighting and other lights can also be used for indicating operation statuses. For example, a green backlighting of a switch could indicate that the corresponding subsystem is functioning correctly while a flashing red light next to the switch could indicate a malfunction status. Audible indicators may be substituted or combined to visual indicators, either to confirm the subsystem is functioning, such as using a chime or a beeping sound, for instance, or to alert the user that the subsystem is malfunctioning, such as using a buzzer, an audible alarm or the like. Hence, various combinations of indicators may be used to indicate the status of the subsystem to a user. An indicator that the switch has been activated may be combined to the subsystem status indicator, for example, a beep may indicate the switch has been depressed, and a double beep may sound once the subsystem is detected to be functioning.

In the present discussion, the preferred means of transmitting information to and from the steering wheel has been described as being infrared transmission. However, other means of data transfer are also possible and may demonstrate to be advantageous depending on the applications. For instance, use of electromagnetic transmission of data using the existing contactless power transfer device of a marine vehicle might prove to be very advantageous. Other types of transmission may be radio frequency transmission, ultrasonic transmission, etc. As will be readily understood, one type of transmission can be used for transmitting the command from the steering wheel to the sub-system and other type can be used for the status information from the sub-system to the steering wheel. Indeed, in a preferred embodiment, the command from the steering wheel to the sub-system is transmitted via infrared transmission while the feedback or status from the sub-system to the switch is sent via radio-frequency transmission.

Figure 3:
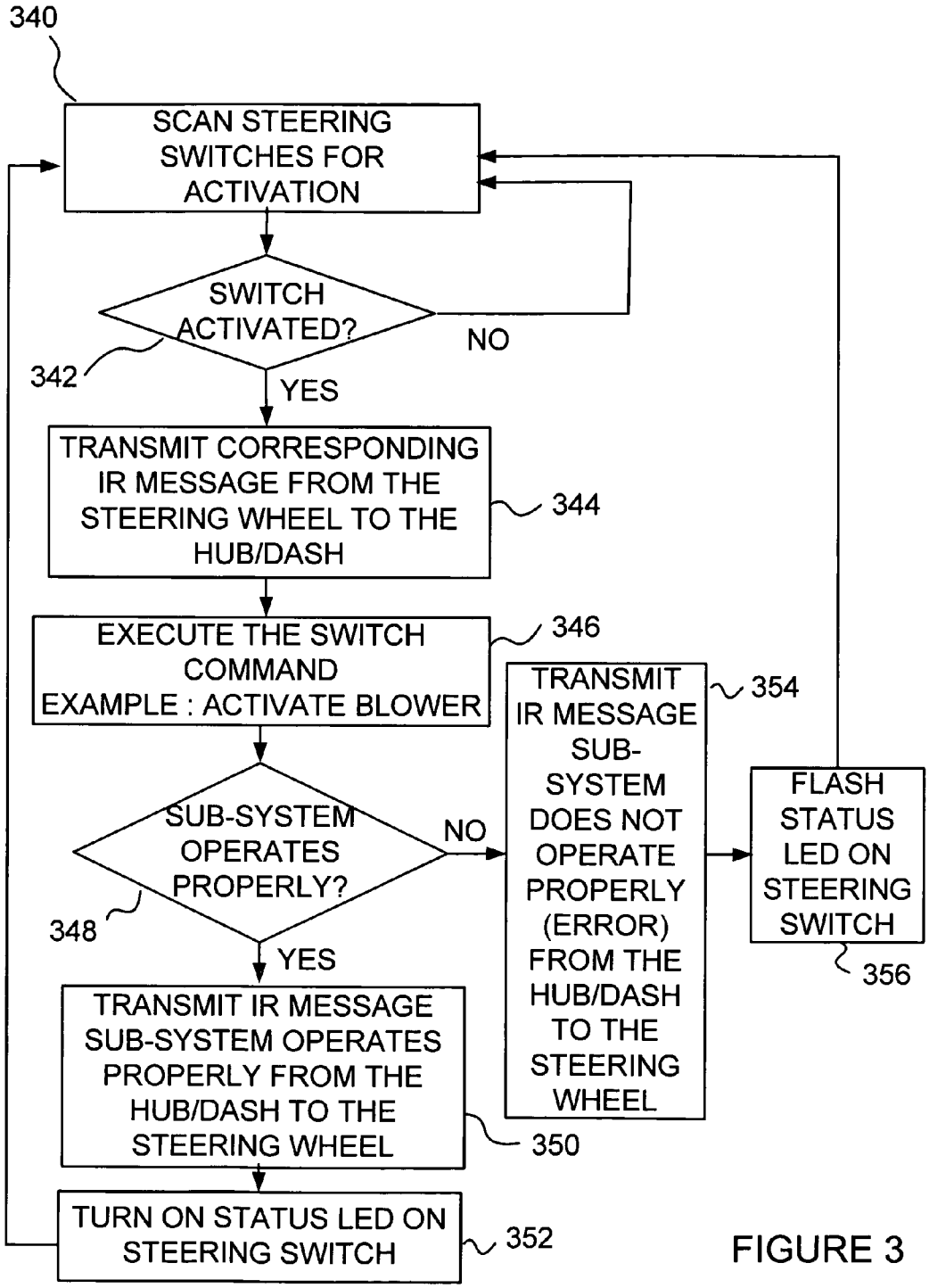
FIG. 3 is a flow chart of the main steps of a preferred method of the present invention.

With reference to FIG. 3, the main steps of the preferred method will now be described. The steering wheel assembly switches are scanned by the switch processor to verify if they have been activated 340. The switch processor continues to scan the switches for activation 340 until activation of a switch by a user is detected 342, and then transmits 344 an IR (infrared) message containing the information on the command corresponding to the switch which was activated, from the steering wheel to the hub/dash using the activation transmitter.

The switch command is then received by the subsystem processor. The subsystem processor instructs the proper subsystem on the marine vehicle to execute the switch command using the interface 346. The command is then received by the proper subsystem, and is executed (the subsystem functions), or the command fails and the subsystem does not execute the command properly (the subsystem malfunctions). The processor then awaits a confirmation from the subsystem that the command was executed 348. If the confirmation is received and the command was executed successfully, an IR message is created by the subsystem processor and transmitted 350 to the switch processor, and the appropriate status LED is lit 352. The system then returns to scanning the steering switches for activation 340.

If the confirmation from the subsystem is not received or if a confirmation that the subsystem is malfunctioning is received by the subsystem processor, the subsystem processor transmits 354 an IR message that the subsystem does not operate properly (error message) from the dash to the steering wheel assembly. The switch processor receives the error message and makes the appropriate status LED flash to indicate the error 356. The system then returns to scanning the steering switches for activation 340.

It is also possible for the subsystem processor to constantly monitor the subsystems so that if malfunction appears after a period of adequate functioning, it will not go unnoticed. In this last application, the malfunction indicator will be triggered upon detection of the malfunction. A timer can be used to monitor the activated subsystems at regular intervals.

It will be readily understood by a person skilled in the art that a status of some subsystems of the marine vehicle is apparent to an operator of the marine vehicle. For example, if the horn switch is pressed and there is no horn sound emitted, the operator will know right away that there is a problem with the form subsystem. However, for certain subsystems, the operator has no quick and safe way of determining the status and will benefit from an indication of the status directly on the steering wheel.

Figure 4:
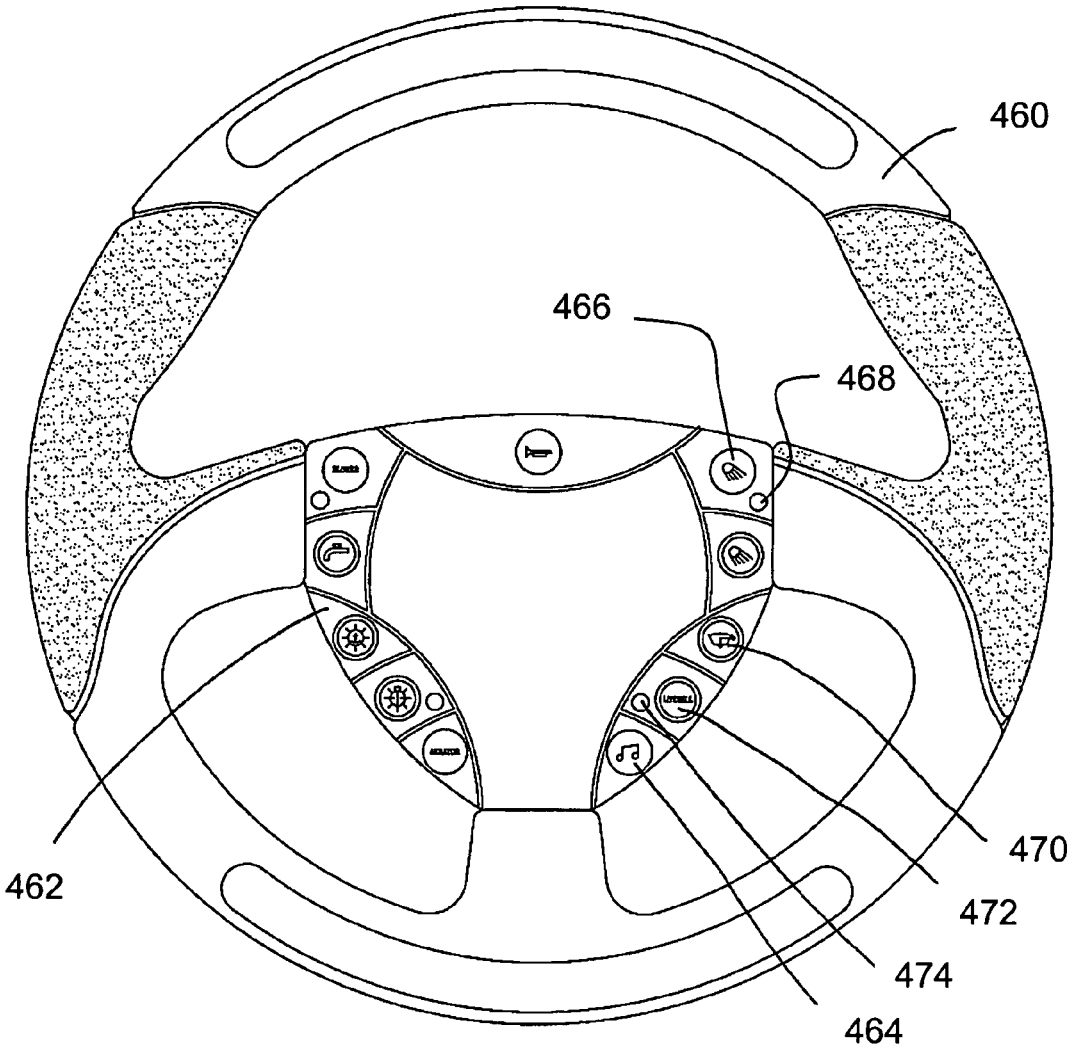
FIG. 4 is plan view of the steering wheel assembly with some switches of the present invention.

FIG. 4 is a plan view of the steering wheel 460 which has a keypad 462 with switches (464, 466, 470 and 472). Three types of switches are illustrated. The first type is a backlit button 464 which is lit or flashes depending of the operation status of the subsystem. This can be achieved by backlighting the button with a LED. The second type is a simple button 466 that has a LED 468 next to it. A third type of button is a button surrounded by a backlighting ring 470. A fourth type of button is a combination of the two previous ones: a button surrounded by a backlit ring 472 that has a LED 474 next to it. The light ring is backlit and the button is lit or flashes depending on the status of the subsystem. Other combinations of backlighting, switches and LEDs may be used to indicate the operation status of a subsystem.

It will be understood that numerous modifications to the preferred embodiments will appear to those skilled in the art. Accordingly, the above description and accompanying drawings should be taken as illustrative of the invention and not in a limiting sense. It will further be understood that it is intended to cover any variations, uses, or adaptations of the invention following, in general, the principles of the invention and including such departures from the present disclosure as come within known or customary practice within the art to which the invention pertains and as may be applied to the essential features herein before set forth, and as follows in the scope of the appended claims.

What is claimed is:

1. A method for indicating a status of a subsystem controlled by a switch provided on a steering wheel of a marine vehicle, comprising:

providing a switch for said subsystem on said steering wheel of said marine vehicle; providing a status indicator for said switch; detecting an activation of said switch;

transmitting a command to said subsystem in said marine vehicle in response to said activation wherein said command transmission comprises using infrared transmission;

detecting an operation status of said subsystem in response to said command; and activating said status indicator to indicate said operation status as detected;

wherein said infrared transmission comprises: generating a National Marine Electronics Association (MNEA) 2000 encoding compliant command data train comprising information about said command; emitting said NMEA 2000 encoding compliant command data train using infrared; capturing said command data train; and receiving said captured NMEA 2000 encoding compliant command data train.

2. The method of claim 1 wherein said infrared transmission comprises: generating a command data train comprising information about said command; emitting said command data train using infrared; capturing said command data train; and receiving said captured command data train.

3. The method of claim 1 wherein said detecting comprises transmitting information about said operation status and wherein said activation of said status indicator comprises receiving said information transmitted.

4. The method of claim 3 wherein said information transmission comprises using one of: infrared transmission, electromagnetic transmission, radio frequency transmission, and ultrasonic transmission.

5. The method of claim 3 wherein said information transmission comprises: generating a status data train comprising information about said operation status; emitting said status data train; capturing said status data train using infrared; and receiving said captured status data train.

6. The method of claim 1 further comprising:

providing a switch activation indicator, and activating said switch activation indicator upon said detection of switch activation.

7. The method of claim 1 wherein said operation status comprises one of functioning and malfunctioning.

8. The method of claim 7 wherein said activating comprises one of: emitting a steady light; emitting a light with a color associated to said functioning status; emitting a combination of lights associated to said functioning status; emitting a distinctive sound associated to said functioning status; emitting a flashing light; emitting a light with a color associated to said malfunctioning status; emitting a combination of lights associated to said malfunctioning status, and emitting a distinctive sound associated to said malfunctioning status.

9. The system of claim 1 wherein said status indicator comprises any one of a visual indicator and an audible indicator.

10. The system of claim 9 wherein said visual indicator comprises at least one of a backlight for said switch, a backlighting ring around said switch, and a LED disposed near said switch.

11. The system of claim 9 wherein said audible indicator comprises at least one of a chime, a buzzer, and an alarm.

12. The method of claim 1 wherein said command transmission comprises using infrared transmission.

13. The method of claim 12 wherein said infrared transmission comprises: generating a NMEA 2000 encoding compliant command data train comprising information about said command; emitting said command data train using infrared; capturing said NMEA 2000 encoding compliant command data train; and receiving said captured NEMA 2000 encoding compliant command data train.

14. The method of claim 1 wherein said detecting comprises transmitting information about said operation status and wherein said activation of said status indicator comprises receiving said information transmitted.

15. A system for indicating a status of a subsystem controlled by a switch provided on a steering wheel of a marine vehicle, comprising:

a switch for said subsystem on said steering wheel of said marine vehicle; a status indicator for said switch;

an activation detector configured to detect an activation of said switch;

an activation transmitter configured to transmit a command to said subsystem in said marine vehicle in response to said activation wherein said activation transmitter comprises an infrared transmitter;

a status detector configured to detect an operation status of said subsystem in response to said command; and an indicator activator configured to activate said status indicator to indicate said operation status as detected by the status detector, wherein said activation transmitter comprises a generator configured to generate an activation data train comprising information about said command encoded to National Marine Electronics Association (NMEA) 2000 compliant standards; an infrared emitting diode configured to emit said activation data train; a phototransistor configured to capture said activation data train; and a signal receiver configured to receive said activation data train.

16. The system of claim 15 wherein said activation detector comprises a switch processor capable of detecting activation of at least said switch.

17. The system of claim 16 wherein said switch processor comprises said indicator activator.

18. The system of claim 15 wherein said status detector comprises a subsystem processor capable of detecting said operation status of at least said subsystem.

19. The system of claim 15 wherein said status detector comprises a status transmitter configured to transmit NEMA 2000 compliant information on said operation status from said operation detector to said indicator activator.

20. A system for indicating a status of a subsystem controlled by a switch provided on a steering wheel of a marine vehicle, comprising:

a switch for said subsystem on said steering wheel of said marine vehicle; a status indicator for said switch;

an activation detector configured to detect an activation of said switch;

an activation transmitter configured to transmit a command to said subsystem in said marine vehicle in response to said activation;

a status detector configured to detect an operation status of said subsystem in response to said command wherein said status detector comprises a status transmitter configured to transmit National Marine Electronics Association (MNEA) 2000 compliant information on said operation status from said operation detector to said indicator activator; and an indicator activator configured to activate said status indicator to indicate said operation status as detected by the status detector wherein said status transmitter comprises: a status generator configured to generate a NMEA 2000 compliant status data train comprising information about said operation status; a status infrared emitting diode configured to emit said status data train; a status phototransistor configured to capture said NEMA 2000 compliant status data train; and a status receiver configured to receive said status data train.

* * * * *